US009783765B2

(12) United States Patent
Zhang

(10) Patent No.: US 9,783,765 B2
(45) Date of Patent: Oct. 10, 2017

(54) BIOTECH WASHING AGENT

(71) Applicant: Hongkai Zhang, Shanghai (CN)

(72) Inventor: Hongkai Zhang, Shanghai (CN)

( * ) Notice: Subject to any disclaimer, the term of this patent is extended or adjusted under 35 U.S.C. 154(b) by 136 days.

(21) Appl. No.: 14/462,319

(22) Filed: Aug. 18, 2014

(65) Prior Publication Data

US 2016/0046893 A1 Feb. 18, 2016

(51) Int. Cl.

| | |
|---|---|
| ***C11D 3/386*** | (2006.01) |
| ***C11D 3/28*** | (2006.01) |
| *C11D 1/83* | (2006.01) |

(52) U.S. Cl.

CPC ..... *C11D 3/386* (2013.01); *C11D 3/28* (2013.01); *C11D 1/83* (2013.01)

(58) Field of Classification Search

None

See application file for complete search history.

(56) References Cited

U.S. PATENT DOCUMENTS 5,877,141 A * 3/1999 Gabriel ..... C11D 3/38663 510/306

FOREIGN PATENT DOCUMENTS

CN 101921673 * 12/2010 ..... C11D 7/40

* cited by examiner

*Primary Examiner* — Necholus Ogden, Jr.

(74) *Attorney, Agent, or Firm* — Novoclaims Patent Services LLC; Mei Lin Wong

(57) ABSTRACT

A natural biotech washing agent for the environment, which is truly natural and environment friendly, for removing oil stains and dirt on a clothing object and degrading the oil and dirt at the same time without using any powered tools, comprising a composition by percentage weight containing 0.5% marine alkaloids, 6.5-9.5% surfactant and 2.5-3.5% enzymes as active ingredients. The biotech washing agent is truly meant for the environment in that the composition is natural, the cleaning process is natural and energy-saving, the cleaning effect is great, the end products after cleaning is natural and cause no harm to the environment, and no powered tools is required to achieve the cleaning effect. In addition, the wastewater after the washing process of the present invention can continue to provide a cleaning effect to the sewage and the wastewater.

1 Claim, 5 Drawing Sheets

Table 1: Properties of the marine alkaloids

| | |
|---|---|
| Appearance | Clear and transparent solution without any solid particles |
| pH value | 8.0-8.5 |
| Colony forming unit (CFU/g) | ≤1000 |
| Bubble measurement 40°C /mm | ≥50 |
| Bioactive content % | ≥5 |
| Fecal coliform | Not detected |
| *Staphylococcus aureus* | Not detected |

Table 1: Properties of the marine alkaloids

| | |
|---|---|
| Appearance | Clear and transparent solution without any solid particles |
| pH value | 8.0-8.5 |
| Colony forming unit (CFU/g) | ≤1000 |
| Bubble measurement 40°C /mm | ≥50 |
| Bioactive content % | ≥5 |
| Fecal coliform | Not detected |
| *Staphylococcus aureus* | Not detected |

BIOTECH WASHING AGENT

BACKGROUND OF THE PRESENT INVENTION

Field of Invention

The present invention relates to a washing agent, and more particularly to a natural biotech washing agent for the environment which is capable of removing oil stains and dirt on a clothing object and degrading the oil and dirt at the same time without using any powered tools.

Description of Related Arts

Traditional washing agent includes petrochemicals, which are chemicals derived from petroleum. In general, this type of washing agent is insoluble in water, easily leaving residue onto the object for cleaning or washing. In addition, the content of this type of washing agent contains ABS, which is toxic and harmful to skin, causing the skin to become dry and rough. Furthermore, any residue of which may accumulate in liver and cause harmful effect to health over time. Phosphate-containing formulation of conventional washing agent causes further harm to the environment and human society. In general, traditional petrochemicals formulated washing agents are not suitable for skin-sensitive user.

The mechanism of washing is non-environmental friendly by itself. On one hand, artificial chemicals are used for manufacture of washing detergent. On the other hand, the dirt or stain are simply separated from the object for cleaning while a lot of energy, such as electrical energy for powering a washing machine or the energy input for cleaning, are used or wasted. There is no ecological thinking for conventional cleaning process. In particular, no thought is put onto a cleaning process for the natural ecological process and the environment.

Traditional washing agent relies on the surface tension mechanism for separation of stain or dirt on the object for cleaning. In this regards, a large variety of surfactants or additives are developed, which includes organic solvent or harmful materials. For example, the use of phosphate to provide a powerful cleaning effect has resulted in algal bloom, low oxygen level and fish deaths. In addition, cleaning process which is based on surface tension mechanism has a lot of limitations which may adversely affect the cleaning effect. Examples are insufficient rubbing or brushing, or insufficient mixing. On the other hand, excessive rubbing or brushing may cause damage to the object for cleaning.

Traditional washing agent as household use for laundry, kitchen cleaning and the like relies on the use of rubbing process, brushing process and/or mixing process with powered or manual tools such as washing machine or powered brushes. The energy consumption requirement is relatively high.

SUMMARY OF THE PRESENT INVENTION

In view of the above problems of convention cleaning, an object of the present invention is to provide a biotech washing agent for cleaning an object for cleaning which is truly environmental friendly. In particular, neither electrically-powered washing machine nor labor force is required for washing the object for cleaning, while the formulation is 100% natural and no toxic or hazardous by-products are produced.

Another object of the present invention is to provide a biotech washing agents cleaning an object for cleaning which contains biological natural ingredients which is capable of providing a cleaning process as well as a biodegradable process at the same time such that the process of cleaning is ecologically useful for the environment.

Another object of the present invention is to provide a biotech washing agents cleaning an object for cleaning through which the end products after cleaning is natural and cause no harm to the environment.

Another object of the present invention is to provide a biotech washing agents cleaning an object for cleaning, which is easy and convenience to use while the cleaning effect is significantly greater than a conventional washing agent.

Another object of the present invention is to provide a biotech washing agents cleaning an object for cleaning which does not rely on the surface tension mechanism for providing the cleaning effect such that the biotech washing agent can be used in a large number of objects for cleaning purpose without causing any damage to the object for cleaning. For example, no excessive rubbing or brushing will be resulted since no such action is required during the cleaning process.

Accordingly, in order to accomplish the above objectives, the present invention provides a biotech washing agent for washing an object for cleaning which comprises a composition by percentage weight containing active ingredients of 0.5% marine alkaloids, 6.5-9.5% surfactant and 2.5-3.5% enzymes.

The marine alkaloids are obtained from the ocean. The surfactant is obtained from or derived from coconut oil. The ingredients of the biotech washing agent are all natural ingredients which is capable of providing a very strong cleaning effect through a biological process.

Preferably, the composition by percentage weight comprises 0.5% marine alkaloids, 6.5% surfactant, 2.5% enzymes and 90.5% deionized water. The surfactant is composed of 2.5% anionic surfactants and 4% non-ionic surfactants. The enzymes is one or more selected from the group consisting of lipase, protease, cellulase and amylase. The anionic surfactant has an anionic functional group of polyoxyethylene lauryl ether sulfate and the non-ionic surfactant is composed of alkyl polyglycosides.

In particular, the biotech washing agent utilizes a mechanism of cleaning which is a biodegradable process, which comprises the step of biodegrading a stain object into basic and natural composition. For examples, the step may be a step of biodegrading an oil stain into glycerin, fatty acid and water such that the oil stain is removed from the object for cleaning.

In addition, a process of cleaning with the biotech washing agent comprises the steps of:

(a) diluting the biotech washing agent with water to form a diluted biotech washing agent; and (b) immersing the object for cleaning into the diluted biotech washing agent and waiting for a predetermined time.

Preferably, the predetermined time is 2 hours.

In particular, the marine alkaloids is extracted from ocean and is a clear and transparent solution with a pH of 8.0-8.5 and has a bioactive content greater than or equal to 5%.

DETAILED DESCRIPTION OF THE PREFERRED EMBODIMENT

Figures 1, 2:
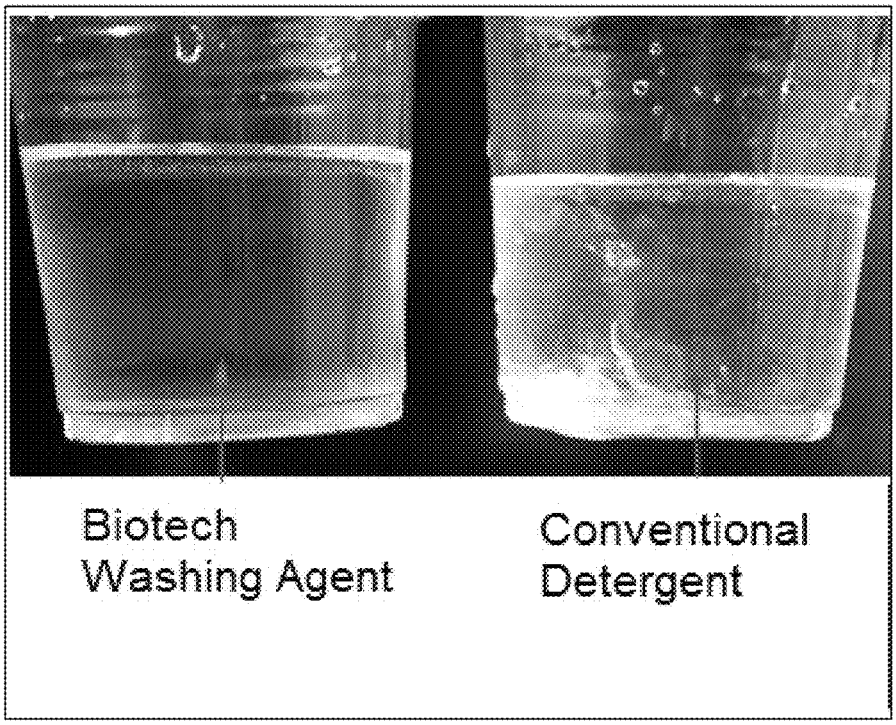
FIG. 1 is a table showing the properties of the marine alkaloids according to the preferred embodiment of the present invention.
FIG. 2 is an illustration of results of solubility test.

The present invention is further described in details with the accompanying drawings and embodiments.

Ocean is a magic place which has self-washing and cleaning capabilities. Tons of waste materials such as plants, animals or micro-organisms are produced in the ocean every day but the ocean is capable of refreshing by itself. In addition to this magical self-washing or cleaning capabilities, the ocean is capable of removing stains or dirt, or even providing sterilization function without producing any toxic effect. The elements of biotech washing agent comes from the ocean and is capable of making a great difference to human washing activities and habit. The self-purifying property of the ocean is employed in the biotech washing agent of the present invention.

According to the preferred embodiment of the present invention, the biotech washing agent has a composition by percentage weight comprising the following active ingredients: 0.5% marine alkaloids, 6.5-9.5% surfactants and 2.5-3.5% enzymes.

The surfactant is derived from coconut oil, which is natural and biodegradable. Preferably, the surfactants contain 2.5-4% anionic surfactants and 4-5.5% non-ionic surfactants.

Preferably, the enzymes are selected from one or more of lipase, protease, cellulase and amylase.

According to the biotech washing agent of the present invention, the biotech washing agent is capable of removing oil stain or dirt through biodegradation process at a high speed. The process is just like a piece of dirt is being eaten by thousands of washing agent media. The biotech washing agent according to the present invention is capable of providing a process of washing which is clean and hygiene by itself. Most importantly, the biotech washing agent or the process of washing does not involves any petrochemicals or toxic and hazardous substances and is 100% natural, healthy and environmental friendly. The biotech washing agent of the present invention is revolutionary in that the biotech washing agent is meant for the environment, which utilizes a natural process as a washing process for the environment and the human society.

In particular, the biotech washing agent according to the preferred embodiment of the present invention comprises marine alkaloids, coconut oil derivatives and one or more of enzymes. The compositions of the biotech washing agent come from the natural environments and is capable of providing a cleaning process through a natural biodegradation process which is natural and clean by itself while the unlimited degradation capabilities of living organisms will continue in the sewage system and the waste water. In other words, the cleaning process can continue in the wastewater, in the septic tanks, in the rivers and in the lakes, and in the ocean. Not only the oil stain or dirt is cleaned, our environment is cleaned during the process of washing using the biotech washing agent of the present invention. This revolutionary concept can truly assist to clean our Earth while helping us to wash away any unwanted oil stains or dirt.

It is worth mentioning that the wastewater after a washing or cleaning process with the biotech washing agent of the present invention will not lead to water pollution in the water. Compared to cleaning with a conventional detergent or soap, which is a cause of water pollution, the wastewater after the cleaning process of the present invention contains the biotech washing agent, which is a truly natural composition, and the basic and simple products after biodegradation. The biodegradation process by the biotech washing agent can continue in the wastewater and can clean the wastewater through biodegradation. In other words, the biotech washing agent not only helps us to wash our clothes, but also is capable of providing sewage treatment to the wastewater.

Since the principle of cleaning is a biodegradation process, the oil stain or dirt can be removed without using any physical force or without any bubbling effect. It is worth mentioning that the biotech washing agent of the present invention or the process of cleaning using the biotech washing agent of the present invention does not contain or produce carcinogens, benzene, formaldehyde and fluorescent agents. No scrubbing or rubbing is required for the process of cleaning using the biotech washing agent of the present invention and no physical harm or damage will be caused to the object for cleaning. For example, no damage to fiber in clothing will be caused through the process of cleaning using the biotech washing agent of the present invention.

In addition, the marine alkaloids of the biotech washing agent are obtained from the ocean and have strong cleaning effect as well as skin protection, sterilization and anti-inflammatory effect.

For example, according to a first exemplary embodiment of the present invention, the biotech washing agent has a composition by percentage weight consisting of: 0.5% marine alkaloid, 6.5-9.5% surfactant, 2.5-3% enzyme and 88-83.5% deionized water. Preferably, the surfactant contains 2.5-4% anionic surfactant and 4-5.5% non-ionic surfactant. Preferably, the enzyme is selected from one or more of lipase, protease, cellulase and amylase.

Alkaloids are generally defined as naturally occurring basic nitrogenous compounds, the majority of which displays biological activity. Marine alkaloids refers to alkaloids derived from the ocean which display biological activity. Common examples includes pyridoacridine alkaloids, pyrroloacridine alkaloids, indole alkaloids, beta-carboline alkaloids, pyrrole alkaloids, isoquinoline alkaloids, and tyrosine derived alkaloids.

The surfactant comprises anionic surfactant and non-ionic surfactant. The anionic surfactant contains an anionic functional groups at their head, such as sulfate, sulfonate, carboxylates and sarcosine. The anionic surfactant includes salts of sodium, potassium, ammonium and substituted ammonium such as mono-, di- and triethanolamine. Preferably, the anionic functional group of the anionic surfactant is selected from sulfate or sulfonate. In particular, polyoxyethylene lauryl ether sulfate is the most preferred functional group, which has the chemical formula as follows:

$$R^1O(CH_2CH_2O)n\text{-}SO_3Y$$

Where $R^1$ refers to a saturated or unsaturated hydrocarbyl group with 10-18 carbon atoms, Y refers to an alkali metal atom, an alkali earth metal atom, an alkanolamine, an ammonium or a basic amino acid, n refers to the average number of moles of ethylene oxide being added, which is 0-5, and preferably 1-3.

The non-ionic surfactant is selected from alkyl glycosides, polyoxyalkylene (preferably oxyethylene) alkyl or alkenyl ethers, polyoxyalkylene fatty acid esters of sorbitol and sorbitol anhydrides, polyoxyalkylene sorbitan fatty acid esters, polyoxyethylene sorbitan fatty acid esters, polyoxyalkylene glycerol fatty acid fatty acid esters, polyglycerol fatty acid esters, fatty acid monoglycerides, and polyethylene glycol ester of fatty acid. Preferably, the non-ionic surfactant is alkyl polyglycosides which has the chemical formula as follows:

$$R^3O(C_nH_{2n}O)_t(\text{glycosyl})_x$$

wherein $R^3$ is selected from the group consisting of the followings functional groups: alkyl, alkylphenyl, hydroxyalkyl, hydroxyl alkylphenyl, and their mixtures, wherein the alkyl group contains 10-18, preferably 12-14 carbon atoms; n is 2 or 3, preferably 2; t is 0-10, preferably 0; x is 1.3-10, preferably 1.3-3 and most preferably 1.3-2.7; the glycosyl group is preferably derived from glucose.

The surfactant is derived from coconut oil, which is a 100% natural and biodegradable.

According to the present invention, a process of preparation of the above biotech washing agent is provided. The process comprises the steps of:

(a) pre-heating the deionized water to a temperature of 80° C.;

(b) mixing the surfactant with the deionized water and stirring for 30 minutes through a mixing machine at a rotational speed of 150 rpm to form a first intermediate solution;

(c) cooling the first intermediate solution to 40° C.;

(d) adding the marine alkaloids and the enzyme into the first intermediate solution and mixing for 1 hour at a rotational speed of 150 rpm to form a second intermediate solution; and (e) cooling the second intermediate solution to 25° C. and continue stirring for 30 minutes at a rotational speed of 60 rpm to form a final solution.

Then, the final solution can be prepared into laundry detergent, hand soap, vegetables and fruits washing agent, kitchen detergent or industrial detergent.

The final solution can then be made into a concentrated final solution which can be diluted with water for use.

It is worth mentioning that the biotech washing agent according to the preferred embodiment of the present invention is suitable for washing and cleaning an object for cleaning for a vast variety of items for household or industrial use, which includes but not limited to clothing items, kitchen items, fruit and vegetable items, cars, jewelry, and is also suitable for agricultural, animal husbandry and fishery and industrial use.

Referring to FIG. 1 of the drawings, the marine alkaloids which is used to prepare the biotech washing agent of the present invention is a clear and transparent solution without any participates, has a pH of 8.0-8.5, and a bioactive content percentage by weight greater than 5%. The colony forming unit is less than or equal to 1000 and the bubble measurement is greater than or equal to 50 under 40° C./mm. No fecal coliform or *Staphylococcus aureus* are detected.

It is worth mentioning that the marine alkaloids is natural and safe for use while providing a very strong cleaning power.

Figure 6:
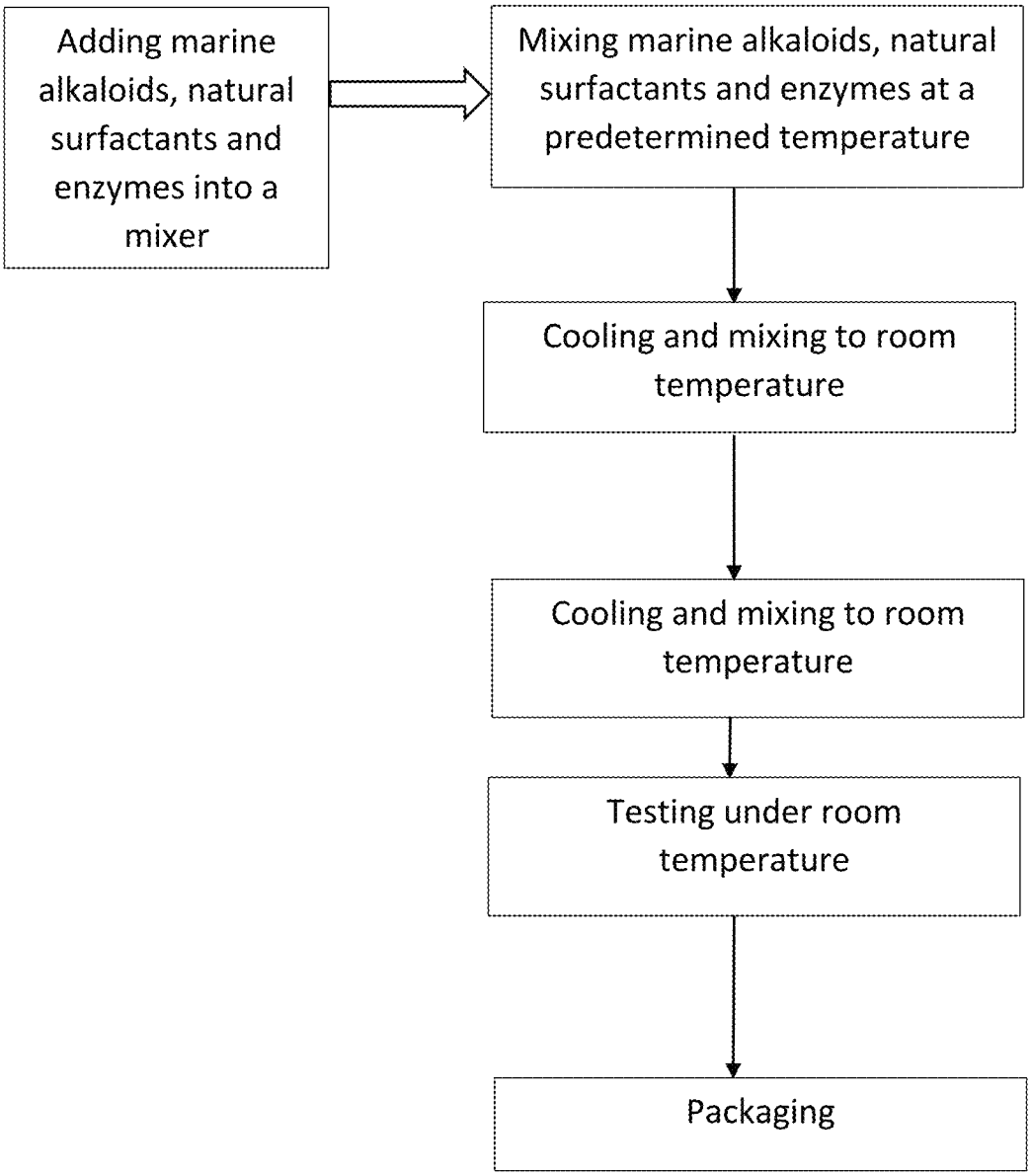
FIG. 6 illustrates a process of preparation of the biotech washing agent according to the preferred embodiment of the present invention

Preferably, referring to FIG. 6 of the drawings, the major steps for the process of preparation of the above biotech washing agent comprises the steps of:

(a) adding the marine alkaloids, the coconut oil derivatives and the enzymes into a mixing machine;

(b) heating to a predetermined temperature and mixing; and (c) cooling and mixing to room temperature.

The resulting biotech washing agent is then sampled for testing under room temperature. According to the testing conducted by Shanghai Municipal Center for Disease Control & Prevention, the resulting biotech washing agent has the following results:

Under the temperature condition at 20-22° C., the biotech washing agent which has a concentration of 0.25% (g/v) marine alkaloids is allow to have activity for 15 minutes. The sterilization rate for *Staphylococcus aureus* (ATCC6538) is equal to or greater than 99.90%.

Under the temperature condition at 20-22° C., the biotech washing agent which has a concentration of 0.25% (g/v) marine alkaloids is allow to have activity for 15-20 minutes. The sterilization rate for *E. coli* (8099) is equal to or greater than 99.90%.

The biotech washing agent has unexpected amazing effect on cleaning. The biotech washing agent not only can provide very strong cleaning power, but also has the effect of skin protection and sterilization as well as anti-inflammatory effect. Also, while providing this amazingly strong cleaning power, the biotech washing agent is truly environmental friendly and can play an important role in our ecosystem.

It is worth mentioning that the biotech washing agent can also provide bleaching effect. In addition, the clothing object will not need additional blueing and softening effect since the biotech washing agent is totally gentle to the clothing for cleaning.

In addition, according to the National Ministry of Agriculture of agricultural quality inspection test center in China, the biotech washing agent of the present invention is tested for removing pesticides. An object for testing, which is pretreated by soaking in a solution containing pesticides methamidophos, is used. After the object for testing is immersed in the biotech washing agent for 15 minutes, 99.99% of the pesticides are removed.

In addition, according to the standard pipe corrosive test conducted by the National Nonferrous Metals Quality Supervision and Inspection Center in China, the biotech washing agent of the present invention is not corrosive to hydrophilic aluminum foil and copper pipe of air-conditioning system.

Exemplary Embodiment 1

The biotech washing agent according to this exemplary embodiment of the present invention has a composition of: 0.5% marine alkaloids, 6.5-9.5% surfactant, 2.5-3.5% enzymes and 90.5-86.5% deionized water. In particular, the surfactants is derived from coconut oil and includes 2.5-4% anionic surfactants and 4-5.5% non-ionic surfactants. The enzymes includes lipase, protease and cellulase. The biotech washing agent is in the form of a solution serving as a laundry detergent.

The biotech washing agent as a laundry detergent is especially suitable for use with clothing made of the following materials: cotton, wool, linen, blend fabrics, synthetic fabrics.

The solubility and the cleaning effect of the biotech washing agent as a laundry detergent according to this exemplary embodiment of the present invention are further illustrated as follows:

Solubility Test

Procedure: Obtain a 200 ml container and add 100 ml of water into the container. Add 5 drops of the biotech washing agent into the container and observe.

Result: The biotech washing agent dissolves immediately and a clear and transparent solution is observed.

The above solubility test is repeated with a conventional laundry detergent and an unclear suspended solution is observed.

The conventional laundry detergent is a petrochemical type.

The solubility test are conducted side by side with the biotech washing agent and the conventional laundry detergent and the results are shown in FIG. 2 of the drawings. It is seen that a clear and colorless solution is observed with the biotech washing agent while an unclear suspended solution is observed with the conventional laundry detergent. The results show that the biotech washing agent is completely soluble in water while the conventional laundry detergent is not completely soluble in water.

Cleaning Capability Test A

Procedure: Obtain two pieces of cloth, each adding a preset amount of shoe polish; obtain two 200 ml container, each adding 100 ml of water; then add 5 drops of biotech washing agent and 5 drops of conventional laundry detergent into the two containers respectively; and wait for 120 minutes and observe.

Figure 3:
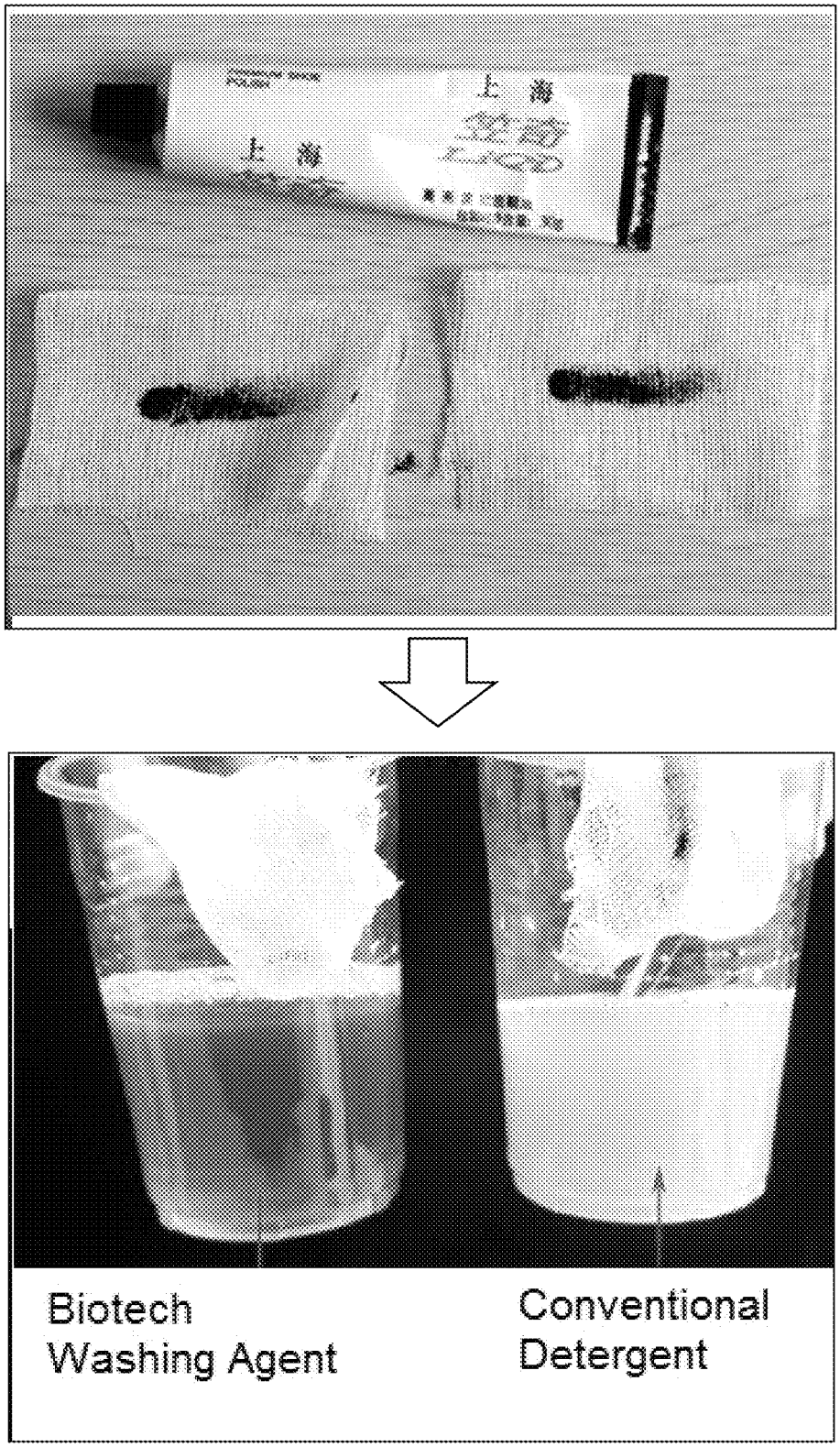
FIG. 3 is an illustration of results of cleaning capability test using shoe polish as an oil stain.

Results: The cloth with the biotech washing agent is cleaned and no shoe polish is seen on the cloth. Trace of shoe polish is seen on the cloth with the conventional laundry detergent. The illustration of the two pieces of cloth is shown in FIG. 3 of the drawings.

The results show that the cleaning capability of the biotech washing agent is much better than the conventional laundry detergent.

Cleaning Capability Test B

Procedure: Obtain two pieces of cloth, each adding two drops of iodine solution; obtain two 200 ml container, each adding 100 ml of water; then add 5 drops of biotech washing agent and 5 drops of conventional laundry detergent into the two containers respectively; and wait for 120 minutes and observe.

Figure 4:
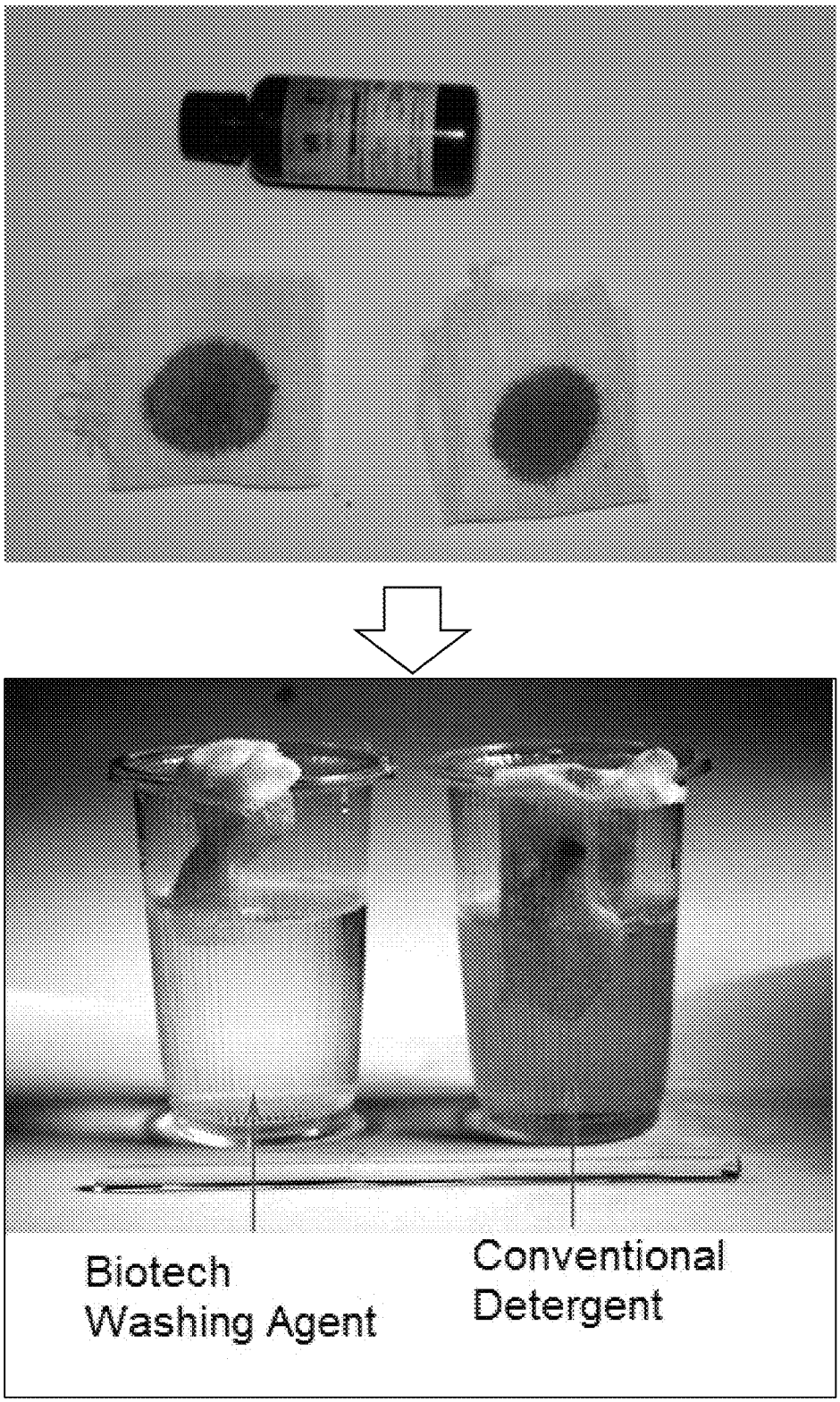
FIG. 4 is an illustration of results of cleaning capability test using an iodine stain.

Results: The cloth with the biotech washing agent is cleaned and no shoe polish is seen on the cloth while a clear and colorless solution is seen inside the container. Trace of iodine solution is seen on the cloth with the conventional laundry detergent while a yellowish solution is seen inside the container. The results are illustrated in FIG. 4 of the drawings.

The results show that the cleaning capability of the biotech washing agent is much better than the conventional laundry detergent.

Accordingly, as seen from the solubility test and the cleaning capability test A and B, the biotech washing agent according to this exemplary embodiment 1 of the present invention has a much superior cleaning effect and higher level of solubility than the conventional laundry detergent. The biotech washing agent according to this exemplary embodiment 1 of the present invention is completely soluble in water and can effectively remove oil stain such as shoe polish stain and iodine stain in a short time without causing any damage to the clothing materials.

Figure 5:
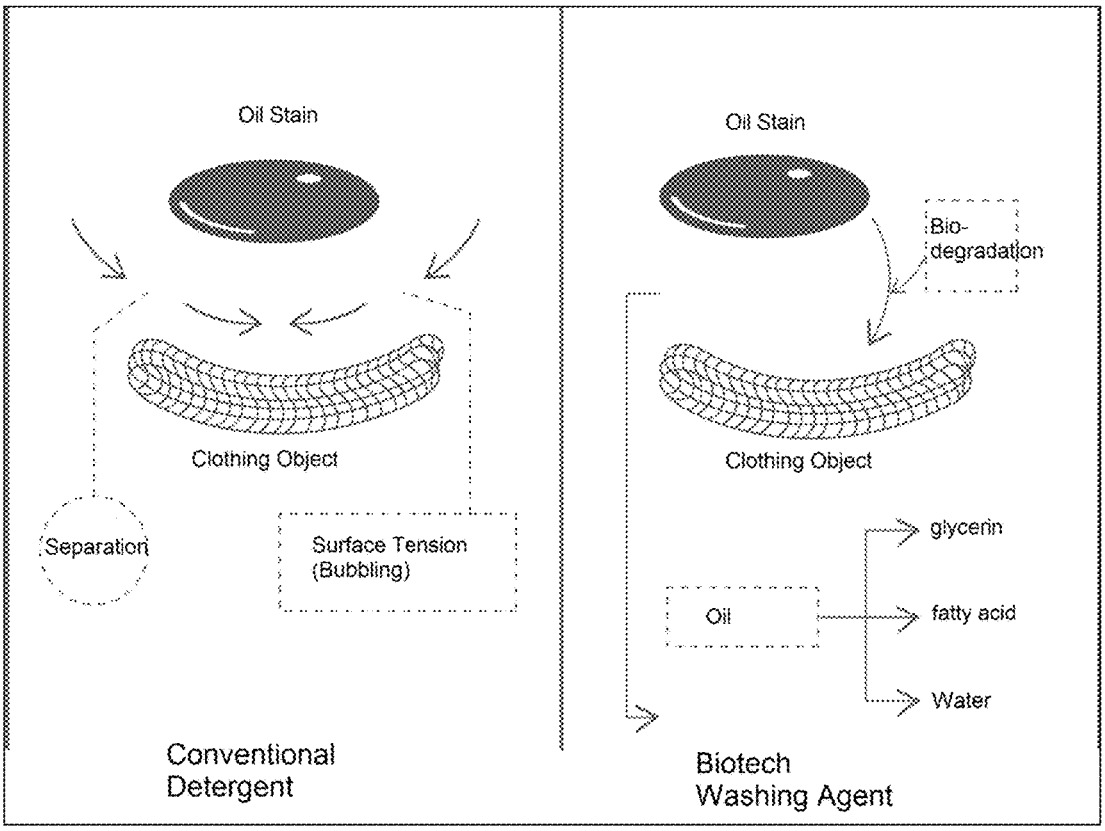
FIG. 5 is an illustration of the principle of cleaning of the biotech washing agent according to the preferred embodiment of the present invention.

In addition, the principle of cleaning is further illustrated in FIG. 5 of the drawings. Referring to FIG. 5 of the drawings, a clothing object with an oil stain is illustrated. The biotech washing agent of the present invention removes the oil stain by process of biodegradation and decomposition through which the oil stain breaks down into glycerin, fatty acid and water. In other words, the by-products for removing an oil stain only includes natural and safe composition of glycerin, fatty acid and water. Compared to conventional petrochemical cleaning, the oil stain is separated from the clothing object through surface tension of bubbles and no process of biodegradation or decomposition is involved.

It is worth mentioning that through the biotech washing agent of the present invention, not only the unwanted oil stain can be removed from the clothing object, but also the oil stain is broken down. In other words, the biotech washing agent of the present invention can clean the cleaning object while helping the unwanted oil stain to break down, therefore providing an important role in our ecosystem.

According to another aspect of the biotech washing agent of the present invention, the biotech washing agent is a machine-free washing agent. In particular, a machine-free washing process comprises the steps of:

(a) Placing a predetermined amount of water into a washing container;

(b) Adding a predetermined amount of the biotech washing agent into the washing container to form a washing agent mixture;

(c) Placing a soiled clothing object into the washing container such that the clothing object is immersed in the washing agent mixture; and (d) Leaving the clothing object in the washing agent mixture for 2 hours.

After the above machine-free washing process, the clothing object is cleaned. No rinsing is required.

In particular, two to five drops of the biotech washing agent can be used in about 500 ml of water for cleaning a clothing object without the use of washing machine or labor force for brushing or rubbing. As the biotech washing agent is complete soluble in water and the cleaning process does not rely on surface tension principle, no washing machine is required for the mixing and bubbling or no manual force is required. This is particularly useful for travelers, campers, non-home based students and is in fact suitable for use for everyone.

It is worth mentioning that the biotech washing agent of the present invention can develop a washing machine free society, which is an important breakthrough in the detergent washing practice. No washing machine means no electrical power requirement, no machine requirement and no location restriction for washing clothes. Cleaning clothes becomes an easy and simple process.

In addition, the wastewater after washing is environmental friendly. No water pollution will be caused to a river or lake near a camp site after a camper uses the biotech washing agent to wash his or her clothes. This is particularly important to area with low degree of wastewater treatment such as some rural villages or less-developed cities or countries.

The biotech washing agent according to the preferred embodiment of the present invention has the following properties:

1. Biodegradable (and decomposition): Dirt or stain can be degraded into natural composition through a natural biodegrading process.

2. Non-restrictive Use: The use of the biotech washing agent does not require any machine such as washing machine and therefore cleaning and biodegrading process can be carried out in any place at any time. The Earth can be cleaned all the time.

3. Non-corrosive: the biotech washing agent does not contains any organic solvent and is harmless to the surface of object for cleaning. In other words, the biotech washing agent can be used in a vast variety of objects.

4. 100% natural in composition: The biotech washing agent is non-toxic, non-harmful and non-petrochemicals containing. A diluted form of the biotech washing agent can even be used for watering a plant or feeding fishes. A skin test for the biotech washing agent is conducted and the test results show that no harmful effect to skin is observed.

5. Phosphate-free formulation which is truly safe for human use.

Exemplary Embodiment 2

The biotech washing agent according to this exemplary embodiment of the present invention is the same as the above exemplary embodiment 1 except that the biotech washing agent is diluted and prepared into a hand soap.

Exemplary Embodiment 3

The biotech washing agent according to this exemplary embodiment of the present invention is the same as the above exemplary embodiment 1 except that the biotech washing agent is diluted and prepared into a body soap. There is no rubbing or scrubbing requirement and therefore no back rubbing or brushing is required when taking a shower or bath.

Exemplary Embodiment 4

The biotech washing agent according to this exemplary embodiment of the present invention is the same as the above exemplary embodiment 1 except that the biotech washing agent has a composition of: 0.5% marine alkaloids, 6.5% surfactant, 2.5% enzymes and 90.5% deionized water. In particular, the surfactants includes 2.5% anionic surfactants and 4% non-ionic surfactants. The enzymes includes one of lipase, protease, cellulase and amylase.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A biotech washing agent for washing an object for cleaning for household use, consisting of a composition by percentage weight containing by percentage weight comprises 0.5% marine alkaloids, 6.5% anionic and non-ionic surfactants, 2.5% enzymes and 90.5% deionized water, wherein the anionic surfactant has an anionic functional group of polyoxyethylene lauryl ether sulfate and the non-ionic surfactant is composed of alkyl polyglycosides, wherein the enzymes comprises lipase, protease and cellulase, wherein a mechanism of cleaning of the biotech washing agent is a biodegradable process which breaks down a stain object to simple non-toxic compounds, wherein the biotech washing agent is non-toxic and the by-products produced from the biodegradable process is non-toxic, wherein the biotech washing agent continues to provide the biodegradable process after washing the object for cleaning.

* * * * *